US006522765B1

(12) United States Patent
Towle

(10) Patent No.: US 6,522,765 B1
(45) Date of Patent: Feb. 18, 2003

(54) HEADSET COMMUNICATION SYSTEM AND METHOD OF USING SAME

(75) Inventor: Lawrence E. Towle, San Diego, CA (US)

(73) Assignee: HM Electronics, Inc., San Diego, CA (US)

( * ) Notice: Subject to any disclaimer, the term of this patent is extended or adjusted under 35 U.S.C. 154(b) by 0 days.

(21) Appl. No.: 09/285,492

(22) Filed: Apr. 2, 1999

(51) Int. Cl.[7] ..... H04R 25/00

(52) U.S. Cl. ..... 381/370; 381/375; 381/384; 455/66; 455/568

(58) Field of Search ..... 381/328, 370, 381/374, 375, 376, 380, 384; 379/430; 174/116, 113 C, 131 A; 455/66, 568

(56) References Cited

U.S. PATENT DOCUMENTS 5,404,577 A * 4/1995 Zuckerman ..... 455/66

5,808,239 A * 9/1998 Olsson ..... 174/113 C

FOREIGN PATENT DOCUMENTS

CA 2070956 * 12/1992 ..... 379/430

* cited by examiner

*Primary Examiner*—Huyen Le

(74) *Attorney, Agent, or Firm*—Foley & Lardner; Bernard L. Kleinke

(57) ABSTRACT

Briefly, in accordance with the present invention, there is provided a novel headset communication system and method for making same, wherein the headset includes at least one earpiece coupled to a transceiver unit via an electrical cable. The cable includes communication wires, and a strength member. The strength member extends axially along the cable providing durability for the cable.

15 Claims, 2 Drawing Sheets

HEADSET COMMUNICATION SYSTEM AND METHOD OF USING SAME

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A "MICROFICHE APPENDIX"

Not Applicable

BACKGROUND OF THE INVENTION

1. Technical Field

The field of the present invention is communication headset systems. More particularly, the present invention relates to the electrical and physical connection of a headset to a transceiver unit.

2. Background Art

In many work environments it is advantageous to allow a worker freedom of mobility while maintaining communications with a remote location. One such work environment is in a fast-food restaurant. An employee of the fast food restaurant needs to communicate to a customer at a remote order taking location. In such a manner, a customer approaches the remote order taking location and is greeted by the employee. The employee proceeds to take the customer's order by communicating with the customer and entering the order into the restaurant's order entry system.

As there are often gaps of time in the order taking process, the order taker has time to perform other functions while taking the order. By providing the employee with a headset communication system, the employee can maintain audio contact with the customer while performing other duties. For example, the employee may fill drinks or package french fries while waiting for a customer to make decisions. Further, the employee may assist other restaurant employees when no customers are waiting at the remote location. However, when a customer arrives at the remote location, the employee may immediately greet the customer and proceed to the order taking system as the customer begins placing an order.

The headset communication system generally comprises a headset having a microphone and an earpiece. The headset is worn on the employee's head in such a manner to enable the earpiece to comfortably be positioned over one of the employee's ears and to position the microphone generally near the employee's mouth. A cable connects the headset to a transceiver which is worn generally on the hips or waist of the employee. Thereby, words spoken by the customer at the remote location are wirelessly transmitted to the transceiver. The transceiver receives the wireless communication and converts it to an electrical signal which stimulates the earpiece, thereby causing the employee to hear the words spoken by the customer.

In a similar manner, as the employee speaks, the microphone produces small electrical signals which are accepted by the transceiver. The transceiver amplifies and converts the signals to a wireless communication which is transmitted to the remote location. The wireless communication is converted to an electrical signal thereby driving a speaker to cause the customer to hear the words of the employee. In such a manner, the customer and the employee may hear and speak to each other in a full duplex manner enabling an efficient order taking process.

Although such headset communication systems are in common usage in fast food restaurants and other work environments, the use of such headset communication systems is hindered by a high rate of breakage. Not only are the headset communication systems subjected to the often severe environment of a fast food restaurant, but communication headsets are often used by entry level employees who severely abuse the headsets. For example, fast food restaurants often employ young people in their first job experience. Such employees frequently use the headsets in a manner which may be inappropriate and which can physically damage the units. Unfortunately, such use and abuse causes the cable to be damaged, thus causing the headset communication system to malfunction.

Even if such use and abuse does not cause the cable to be severed or disconnected, exposure to such usage may cause the cable to have intermittent problems, leading to either a failure of the headset communication system or an inefficient and unpleasant communication session with customers.

Therefore, it would be highly desirable to have an improved headset communication system, which is better able to withstand extremely abusive conditions.

SUMMARY OF THE INVENTION

It is therefore an object of the present invention to provide a communication headset system with substantially reduced maintenance problems due to cable malfunctions.

It is a further object of the present invention to provide a cable for use in a headset communication system where the cable substantially reduces the occurrence of inadvertent breakage or becoming disconnected due to rough or abusive useage.

Briefly, in accordance with the present invention, there is provided a novel headset communication system and method for making same, wherein the headset includes at least one earpiece coupled to a transceiver unit via an electrical cable. The cable includes communication wires, and a strength member. The strength member extends axially along the cable providing durability for the cable.

BRIEF DESCRIPTION OF DRAWINGS

The above mentioned and other objects and features of this invention and the manner of attaining them will become apparent, and the invention itself will be best understood by reference to the following description of the embodiment of the invention in conjunction with the accompanying drawings, wherein.

BEST MODE FOR CARRYING OUT THE INVENTION

Figure 1:
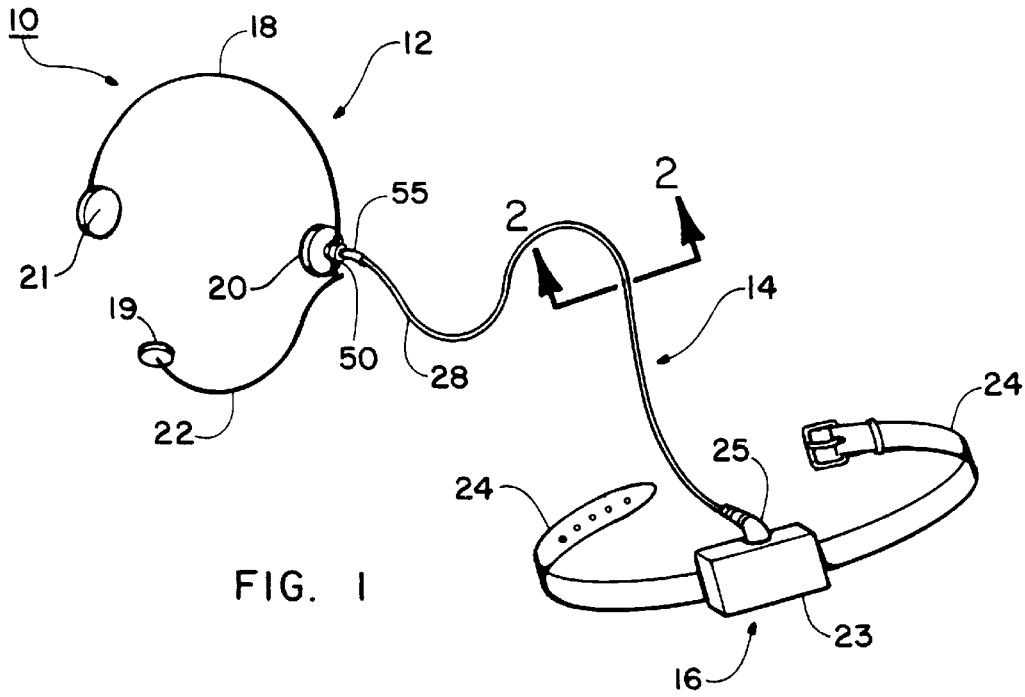
FIG. 1 is a diagram showing a communication headset system made in accordance with the present invention.
Figure 2:
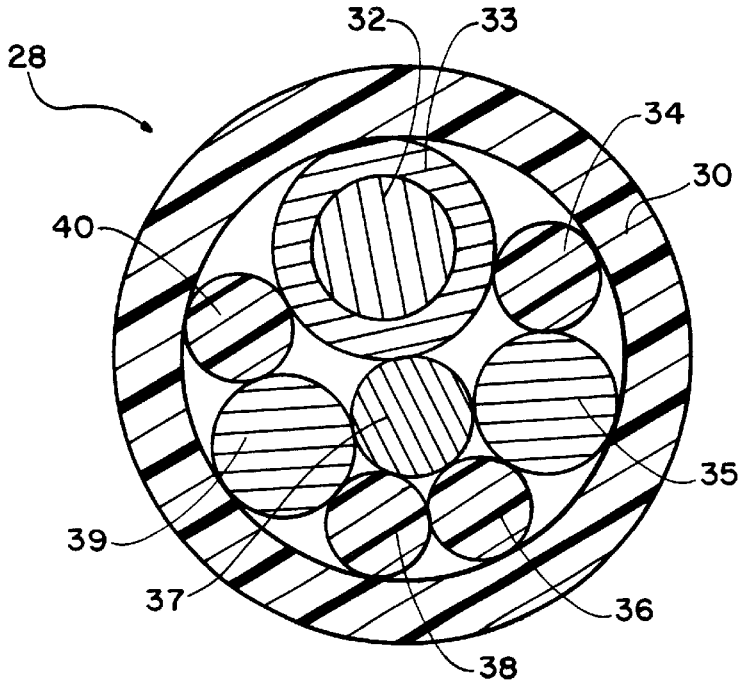
FIG. 2 is an enlarged sectional view of the cable of the system of FIG. 1 taken substantially on line 2—2 thereof.

FIG. 1 shows a headset communication system 10 made in accordance with the present invention. The communication headset system 10 generally comprises a headset 12 connected via cable assembly 14 to the transceiver 16. The cable assembly 14 includes a cable 28. FIG. 2 shows a cross-section of the cable 28 at position 2—2. The cable 28 has electrical wires (32, 33, 35, 39) and a strength member 37 extending axially between the headset 12 to a transceiver coupler 25. The strength member is anchored into the transceiver coupler 25 and securely and fixedly attached to the headset 12. In such a manner the strength member 37 adds sufficient strength and durability to the cable assembly 14, thereby significantly reducing cable breakage and severing.

Turning now to discuss each component in more detail referring again to FIG. 1, the headset 12 of the headset communication system 10 has a head strap 18 supporting a temple pad 21 and an earpiece 20. The earpiece 20 is positionable on the user's ear while the temple pad 21 provides comfortable support on the other side of the user's head. A boom 22 couples to the head strap 18. The boom 22 is typically adjustable in a manner allowing microphone 19 to be positioned near the mouth of the user. Those skilled in the art will recognize that the headset may take various forms. For example, the headset may be an audio headphone headset with a pair of earpieces and no microphone and microphone boom.

The transceiver 16 has a transceiver box 23 with a belt 24 configured to allow the transceiver 16 to be worn on the hip or waist of the user. Those skilled in the art will recognize that the belt may be replaced with other attachment means, such as clips or bands, to allow the transceiver to be worn on other areas of the user's body. Further, those skilled in the art recognize that the transceiver may take various forms. For example, the transceiver unit may be an audio amplifier for sending audio signals to an audio headphone headset.

The cable assembly 14 connects the headset 12 to the transceiver 16. The cable 14 assembly comprises a cable 28 and a transceiver coupler 25. The transceiver coupler 25 is configured to be received into the transceiver box 23. The other end of the cable 28 is configured to be attached to the headset 12.

The cable 28 has a cable jacket 30 defining the outer surface of the cable 28. The cable jacket 30 is typically constructed of a plastic or rubber material, but preferably the jacket 30 is composed of polyurethane. The microphone 19 is electrically connected to the transceiver box 23 via the microphone wire 32 and the microphone ground shield 33. The microphone wire 32 and the microphone ground 33 are configured in the form of a shielded wire. Such a shielded wire configuration is used as the signal from the microphone to the transceiver box 23 is relatively small and therefore subject to disruption by outside electromagnetic interference. The advantageous shielding properties of a shielded wire are used to provide additional shielding for the microphone wire 32 to provide better signal quality.

However, the connection from the earpiece 20 to the transceiver box 23 need not be a shielded connection as the earpiece signals are relatively larger. Therefore, the earpiece 20 is connected to the transceiver box 23 via earpiece wire 39 and earpiece ground 35.

To help provide the cable 28 with a generally circular cross sectional configuration, axially extending filler members 34, 36, 38 and 40 are positioned in portions of the open space within the jacket 30. These filler members 34, 36, 38, and 40 are preferably composed of a plastic material, such as polyester or other insulative material.

The strength member 37 is positioned near the center of the cable 28. The strength member 37 is preferably formed from stainless steel and is most preferably a stranded stainless steel line having about 49 individual strands. Such a strength member has a break strength of at least 90 pounds.

Although a specific configuration for the cable 28 has been described above, those skilled in the art will recognize that other configurations of wires and fillers may be used consistent with the teachings herein.

Figure 3:
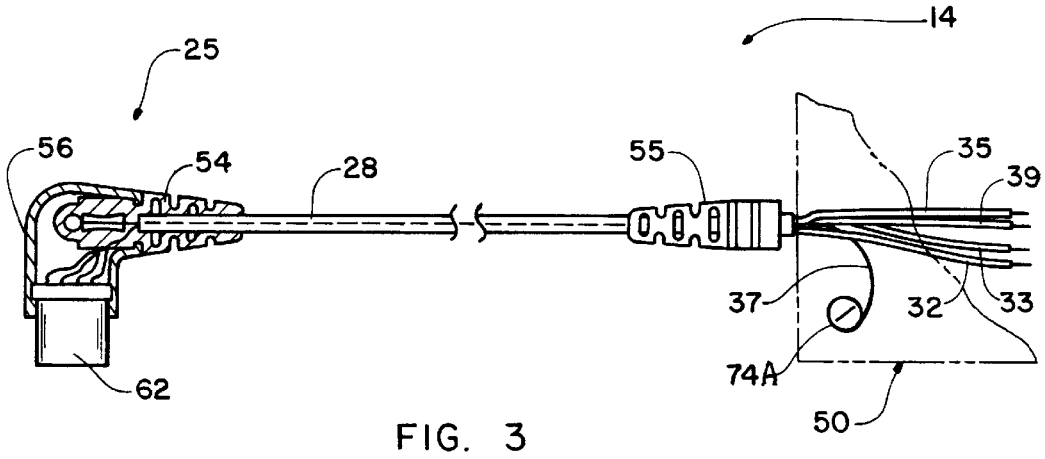
FIG. 3 is a partial cross-sectional view of a cable assembly of the system of FIG. 1.

FIG. 3 shows the cable assembly for connecting the headset 12 to the transceiver unit 16. The cable assembly 14 generally comprises a cable 28 connecting a transceiver coupler 25 to a headset attachment area 50. At the headset attachment area 50, the cable 28 terminates with the individual wires exposed for coupling to the headset 12. Microphone wire 32 and microphone ground 33 electrically connect the microphone, while earpiece wire 35 and earpiece ground 39 electrically connect to the earpiece. Strength member 37 also attaches to the headset for providing strength and durability to the cable 28. The strength member 37 also assists in securing the cable to the headset thereby substantially reducing the circumstance under which the cable will be severed from the headset.

Typically, the electrical wires 32, 33, 35 and 39 attach to screw terminal posts (not shown) located on the headset. In a similar manner, strength member 37 attaches to a screw 74*a* terminal at the headset attachment area 50. Those skilled in the art will readily recognize that other methods exist for connecting electrically the electrical wires and physically connecting the strength member to the headset. The cable assembly 14 also comprises a strain relief 55 at the earpiece end for reducing the risk of cable breakage as the cable 28 attaches to the headset 12. The use of strain reliefs is well-known in the art.

Figure 4:
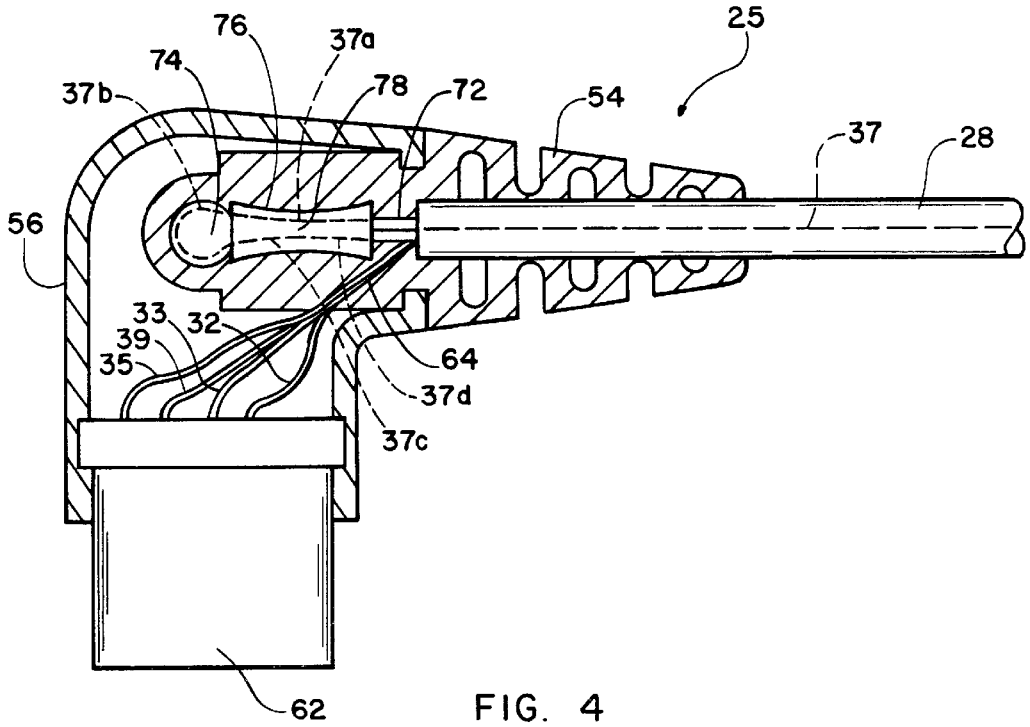
FIG. 4 is an enlarged sectional view of the transceiver coupler of the system shown in FIG. 3.

Transceiver coupler 25 is disposed at the other end of the cable assembly 14. Referring to FIG. 4, the transceiver coupler 25 is shown with cable 28 entering a strain relief 54. The electrical wire bundle 64 leaves the cable 28, thereby exposing the four electrical wires 32, 33, 35, and 39. These wires are attached to connector 62 in a manner permitting the connector 62 to mate with a complementary connector in the transceiver box.

The strength member 37 also exits the cable 28 but is looped around an anchor pin 74 for adding additional support to the strength member 37. The strength member 37 leaves the cable bundle 28, passes thorough a passageway 72, and extends through a crimp clamp 76, as generally indicated at number 37*a*. The strength member 37 exits the crimp clamp and loops around an anchor pin 74, as generally shown at number 37*b*. The strength member 37 enters the crimp clamp as shown at 37*c*, thereby doubling back on itself in the double-back area 78 in the crimp clamp 76. The strength member terminates within the crimp clamp 76 as indicated at number 37*d*.

The crimp clamp 76 is crimped, thus securing the strength member 37 about the anchor pin 74. The crimp clamp 76 and anchor pin are molded into the strain relief 54 thereby securely anchoring the strength member 37 into the strain relief 54.

A right angle connector 56 snaps onto the strain relief 54 with the connector 62 snapping into the other end of the right angle connector 56. The connector 62 can then mate with a complementary connector in the transceiver box thereby permitting the cable assembly 14 to electrically and physically connect the headset 12 to the transceiver unit 16.

The strength member 37 is securely anchored into strain relief 54 at one end of cable 28 and is securely screwed to the headset 12 at the other end. In either regular or abusive use the cable is substantially strengthened so the cable does not sever from the headset, the cable does not break, and the cable does not sever from the strain relief at the transceiver box. However, the transceiver coupler 25 allows the headset 12 and cable assembly 14 to be easily detachable from the transceiver unit 16. Although the strength member is shown attaching to the headset and anchored in the coupler strain relief, those skilled in the art will recognize that the strength member may be terminated in a variety of ways and remain consistent with the inventive concept disclosed herein. For example, couplers may be used at both ends of the cable, or both ends of the cable may be more permanently attached using screws, clamps, or other attachment means.

The process to create cable assembly 14 will now be discussed. To make the cable, microphone wires, earpiece wires, filler wires, and a strength member are bundled together inside a cable jacket. The present cable uses four wires to electrically connect the microphone and earpiece to the transceiver unit. Those skilled in the art will recognize that fewer cables be used. For example, the microphone and earpiece may share a ground, reducing the number of electric wires to three. Further, the cable may carry digital signals, permitting the microphone and earpiece information to be carried on a single wire pair. Indeed, the information may even be carried on an optical strand, reducing to one the necessary wires. The formation of a bundle of wires is well known in the art.

At one end of the cable the microphone and earpiece wires leave the cable jacket and are electrically connected to a connector. The strength member also leaves the cable jacket and is looped about an anchor pin with the strength member doubling back on itself. A crimp clamp is placed about the strength member in the area where the strength member is doubled. The crimp member is crimped using a crimping tool, thereby securing the anchor pin at the end of the strength.

The end of the cable, including the crimp clam and anchor pin, is inserted into an injection molding device. Thereby, the anchor pin and clamp pin become a mold insert in the injection molding device. A strain relief is injection molded about the crimp clamp and anchor pin with the electrical wires and connector extending from the strain relief. Thereby the strength member is securely anchored within the strain relief and the connector and electrical wires extend away from the strain relief. The injection molding process is well known in the art, including molding about a mold insert.

A right angle connector compressibly snaps to the strain release with the electrical connector also snapping into the right angle connector.

At the other end of the cable a strain relief is molded onto the cable with the electrical wires and strength member extending from the strain relief. An end portion of each electrical wire is stripped and tinned for easing connection to a connection terminal. The strength member also extends from the stain relief and is configured for attachment to an attachment terminal.

To make a communication headset system, the connector on the cable is mated to a complementary connector on a transceiver unit. At the other end of the cable, the microphone wires are attached to microphone wire attachment terminals on the headset and the earpiece wires are attached to earpiece terminals on the headset. The strength member is also attached and secured to an attachment terminal on the headset. Those skilled in the art will recognize that the cable could be connected to the headset in a variety of a manners including the use of a connector.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. A reinforced communication headset system, comprising:

a headset including at least one earpiece;

a transceiver unit at a remotely located position relative to said headset; and a cable operably coupling the earpiece to the transceiver, the cable including:

an earpiece wire means extending between the transceiver unit and the headset;

a strength line extending between the transceiver unit and the headset;

a transceiver coupler for connection to the transceiver, and having anchoring means for said strength line; and the strength line being secured mechanically to the headset and secured mechanically to the transceiver coupler via said anchoring means, thereby strengthening the cable and causing the cable to resist breaking and resist being severed from the headset or the transceiver coupler.

2. The headset according to claim 1 where the headset includes a microphone, and the cable includes a microphone wire means extending between the transceiver unit and the headset for operably coupling the microphone to the transceiver.

3. The headset system of claim 1 where the anchor means is an anchor pin for anchoring the strength line.

4. The headset system of claim 3 where the strength line loops around the anchor pin and a crimp clamp assists in retaining the strength line on the anchor pin.

5. The headset system of claim 3 where the anchor pin is a mold insert in a strain relief.

6. The headset system of claim 1 where the strength line attaches to the headset with a terminal screw.

7. The headset system of claim 1 where the transceiver unit is configured to be worn on a user's body.

8. The headset system of claim 1 where the strength line is composed of a metal.

9. The headset system of claim 8 where the metal is stainless steel.

10. A cable for use on a headset communication system, the headset communication system having a headset and a transceiver unit with the cable connecting the headset to the transceiver unit, the cable comprising:

communication wire means extending between the transceiver unit and headset;

a strength line extending between the transceiver unit and the headset;

a transceiver coupler for connection to the transceiver, and having anchoring means for said strength line; and the strength line being secured mechanically to the headset and secured mechanically to the transceiver coupler via said anchoring means, thereby strengthening the cable and causing the cable to resist breaking and resist being severed from the headset or the transceiver coupler.

11. The cable of claim 10, wherein the communication wire means includes microphone and earpiece wire means for operably connecting a microphone and an earpiece to the transceiver.

12. The cable of claim 10, wherein the anchor means is an anchor pin for anchoring the strength line.

13. The cable of claim 12, wherein the strength line loops around the anchor pin and a crimp clamp assists in retaining the strength line on the anchor pin.

14. The headset system of claim 10, wherein the strength line is composed of stranded stainless steel.

15. The cable according to claim 10 wherein the microphone and earpiece wire means is four electrical wires, three electrical wires, two electrical wires, or an optical wire.

* * * * *